US005088885A

United States Patent [19]

Schwarz et al.

[11] Patent Number: 5,088,885

[45] Date of Patent: Feb. 18, 1992

[54] METHOD FOR PROTECTING GAS TURBINE ENGINE SEALS

[75] Inventors: Fred M. Schwarz, Glastonbury; Ken R. Lagueux, Berlin, both of Conn.

[73] Assignee: United Technologies Corporation, Hartford, Conn.

[21] Appl. No.: 420,196

[22] Filed: Oct. 12, 1989

[51] Int. Cl.[5] ..... F01D 5/08

[52] U.S. Cl. ..... 415/115; 415/116; 60/39.29

[58] Field of Search ..... 415/115, 116, 126, 127; 60/39.75, 39.29

[56] References Cited

U.S. PATENT DOCUMENTS 4,019,320 4/1977 Redinger, Jr. et al. ..... 415/116
4,069,662 1/1978 Redinger, Jr. et al. ..... 415/116
4,304,093 12/1981 Schulze ..... 60/39.29
4,329,114 5/1982 Johnston et al. ..... 415/145
4,487,016 12/1984 Schwarz et al. ..... 60/204
4,645,416 2/1987 Weiner ..... 415/115
4,893,983 1/1990 McGreeham ..... 415/116
4,893,984 1/1990 Davison et al. ..... 415/116

*Primary Examiner*—John T. Kwon
*Attorney, Agent, or Firm*—Troxell K. Snyder

[57] ABSTRACT

A method for preventing rubbing between a gas turbine engine rotor and surrounding annular shroud during transient changes in engine power monitors high rotor speed for determining the existence of a thermal mismatch between the rotor and shroud supporting turbine case (9). The method directs the cooling flow modulating valve (44) to substantially shut off the flow of cooling air to the case (9) for a period of time sufficient to allow the thermal mismatch to pass.

4 Claims, 1 Drawing Sheet

METHOD FOR PROTECTING GAS TURBINE ENGINE SEALS

DESCRIPTION

1. Field of the Invention

Present invention relates to a method for controlling cooling air to a gas turbine engine.

2. Background

The reduction of the running clearance between the tips of the rotating turbine blades of a gas turbine engine and the surrounding annular shroud is a technical problem which has occupied gas turbine engine designers and manufacturers. One successful technique for reducing this clearance has been to impinge a flow of external cooling air on the supporting turbine case for the purpose of cooling the case and thereby reducing the inner diameter of the supported shroud. By judicious regulation of the flow of such cooling air, the shroud may be brought sufficiently close to the rotating blade tips so as to reduce the quantity of turbine working fluid which bypasses the rotating blade stages, but not so close as to result in contact between the shroud and blade tips.

The response of the turbine case and the bladed rotor to changes in the engine throttle and power level have recently been scrutinized to determine if modifications to the cooling flow control are required. Co-pending, commonly assigned U.S. Patent applications titled Clearance Control Method for Gas Turbine Engine, U.S. Ser. No. 07/372,398, by F. M. Schwarz, et al. and Active Clearance Control with Cruise Mode, U.S. Ser. No. 07/370,434, by F. M. Schwarz, et al. relate to methods of modifying the steady state cooling airflow schedule in order to accommodate possible step increases in throttle or engine power level without causing blade tip to shroud interference. Such methods, however, do not take into account the recent power level history of the gas turbine engine.

The recent power level history of an engine has been found to be of importance in predicting the occurrence of blade tip to shroud interference during a re-acceleration of the engine within a short time of a prior deceleration of the engine. Engines operating at normal flight power under steady state conditions experience an immediate transient increase in blade tip to shroud clearance following a step reduction in engine power. This increase results from the deceleration of the turbine rotor angular speed and a corresponding reduction in the centrifugal forces acting on the individual blades. For engines operating with steady state cooling flow schedules responsive to only the engine rotor speed, this increased clearance undergoes a subsequent transient decrease as the cooling air directed against the turbine case, in conjunction with the reduced temperature working fluid now passing through the turbine section of the engine, results in a decrease in case temperature and, hence, diameter.

In this initial time period following the engine deceleration, the turbine rotor is also cooling and shrinking radially as the working fluid temperature declines, however, the turbine rotor is far more massive and, hence, has a larger heat capacity than the surrounding turbine case, thereby requiring a longer time to reach its corresponding steady state, low power size. A problem has been found to occur if the engine is re-accelerated to normal operating power during this time period following the initial deceleration in which the case has been cooled to its steady state, lower power diameter before the turbine rotor has reached its corresponding steady state dimension. The effect of the re-acceleration is a rapid increase in turbine rotor speed thereby restoring the centrifugal forces on the turbine blades which may expand radially a sufficient distance to result in a blade tip to shroud interference. Although the temperature of the working fluid passing through the turbine does increase as a result of the re-acceleration, the thermal effect on the case does not result in re-expansion of the case as quickly as the increased rotor speed causes radial growth of the turbine blade tips.

What is needed is a method of accommodating the re-acceleration of the gas turbine engine following a prior deceleration from normal operating power.

SUMMARY OF THE INVENTION

The invention provides a method for preventing rubbing or radial interference between the blade tips of the turbine rotor and the surrounding shroud during a re-acceleration subsequent to a deceleration. The invention senses a drop in the rotor speed and overrides the controller for the turbine case cooling air valve, commanding it to shut for a period of time during which the transient effect of the deceleration is permitted to pass. The controller is released at the expiration of the time period, allowing the valve and turbine case cooling system to resume normal operation.

The shutting of the valve eliminates the flow of external case cooling air, permitting the case to become warmer as a result of the flow of the heated combustion products through the turbine. The temporarily warmer case increases the running clearance between the tips of the rotor blades and the case supported shroud. This additional clearance is sufficient to accommodate the potential short term radial growth of the blade tips as a result of a re-acceleration to full load operation before the turbine rotor has reached the steady state reduced power dimension.

DETAILED DESCRIPTION OF THE INVENTION

Figure 3:
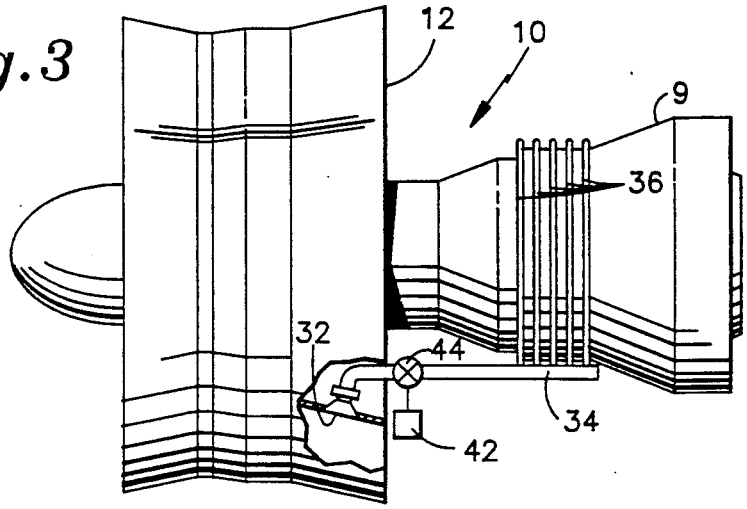
FIG. 3 shows a schematic of a gas turbine engine with a system for delivering a modulated flow of cooling air to the exterior of the turbine case.

Referring now to the drawing figures, and in particular to FIG. 3, which shows a turbofan gas turbine engine 10 having a fan case 12 and a turbine case 9 which is cooled by the impingement of the relatively cool air discharged from openings (now shown) in a plurality of encircling discharge tubes 36. The tubes 36 receive the cooling air from a supply header 34 which receives cool air from the fan case 12 by an opening 32 provided therein. Cooling airflow is regulated by a modulated valve 44 which is controlled by a controller 42 operating according to the method as disclosed hereinbelow.

As noted in the preceding background section, the use of relatively cool air impinged directly on the turbine case 9 reduces turbine case temperature and, hence diameter, thereby reducing the radial clearance between the tips of the blades of the turbine rotor (not shown) and the surrounding annular shroud or air seal (not shown) which is supported concentrically within the outer turbine case 9. The structural details of the turbofan engine 10 are well known in the art and will therefore not be repeated here.

Figure 1:
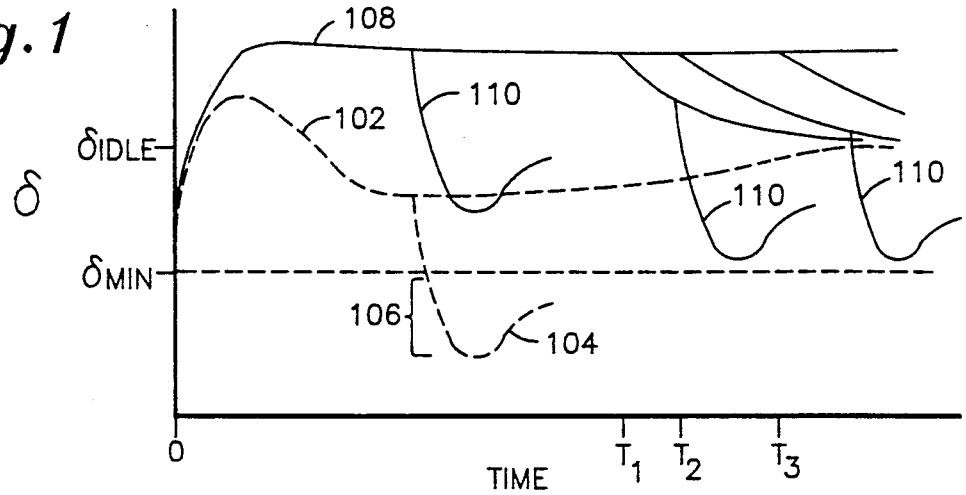
FIG. 1 shows a graph of the transient response of the radial clearance between the blade tips and shroud following deceleration for subsequent re-acceleration.

FIG. 1 shows the transient response of the blade tip to shroud clearance $\delta$ following a decrease in engine power level from steady state operation at operating or cruise power to flight idle power level or some other significantly reduced power level. The reduction in power level occurs at time equals zero and results in an immediate increase in clearance from the steady state clearance corresponding to $\delta_{MIN}$. The immediate increase in blade tip to shroud clearance is the result of the corresponding decrease in rotor speed which reduces the centrifugal force on the turbine blades thereby reducing the overall diameter of the turbine blade tips.

The broken curve 102 in FIG. 1 represents the current state of the art for impingement cooling systems wherein the flow of cooling air to the turbine case 9 is controlled as a function of rotor speed. As can be seen clearly from FIG. 1, while experiencing an initial increase in clearance, the clearance $\delta$ represented by curve 102 then decreases transiently as the temperature of the turbine case 9 declines to the steady state, part power level. Clearance then gradually increases to the part power steady state level $\delta_{IDLE}$ as the massive turbine rotor reaches its lower equilibrium temperature. The variation in clearance over time is thus a result of the heat capacity and response mismatch between the relatively thin turbine case 9 and the more massive turbine rotor (not shown). It is during this period immediately following a decrease in engine power level from cruise to idle power levels, wherein the temperature mismatch between the turbine rotor and turbine case is most pronounced and in which the method according to the present invention is most effective in protecting the blade tips and shroud from interference.

The problem is best recognized by viewing the effect of an increase in engine power level during this transient period. Broken curve 104 shows the effect on blade tip to shroud clearance of a subsequent acceleration of the engine back to cruise power level before the turbine rotor has reached flight idle temperature. The relatively rapid increase in rotor speed results in a reimposition of centrifugal forces on the turbine blades and an increase in blade tip diameter. This increase is relatively rapid and occurs more quickly than the concurrent thermal effect of the increasing temperature of working fluid on the turbine case 9. Thus the blade tips grow radially more quickly than the turbine case resulting in interference or rubbing of the blade tips and surrounding shroud. The mismatch is shown by the excursion 106 of the curve 104 below $\delta_{MIN}$, as shown in FIG. 1.

This excursion 106 can result in contact between the blade tips and the shroud, removing shroud material and permanently opening the clearance between the shroud and blade tips during subsequent operation of the gas turbine engine by removing shroud material, reducing overall gas turbine engine efficiency, increasing fuel consumption and shortening shroud service life. Simply put, the effect of a single excursion such as is shown by curve 104 may significantly or completely diminish the efficiency advantage achieved by the use of external turbine case cooling by causing the removal of a significant portion of the surrounding shroud or air seal.

The method according to the present invention recognizes that a temporary thermal mismatch between the turbine case and turbine rotor occurs following a significant deceleration or decrease in engine power and accommodates this mismatch by temporarily interrupting the operation of the cooling flow modulating control 42 when a decrease in engine power level is detected. The method according to the present invention provides for a temporary interruption of cooling airflow to the turbine case 9 by substantially shutting the modulating valve 44 for a period of time following a decrease in engine power level. The length of time of the decrease is a function of both the initial engine power level and of the magnitude of the reduction.

A transient effect of the use of the method according to the present invention is shown in FIG. 1 by solid curve 108. As with the prior art, the reduction in engine power level from cruise to idle results in an immediate increase in the clearance $\delta$ as a result of the decrease in turbine rotor speed. With the method according to the present invention, this increased clearance is maintained by eliminating the flow of cooling air to the turbine case 9 temporarily, thereby resulting increased turbine case temperature and, hence diameter.

After sufficient time has elapsed to allow the turbine rotor to equilibriate thermally, control of the flow of cooling air is returned to the normal controller 42 resulting in the curves which initiate at times $T_1$, $T_2$, and $T_3$. As noted above, $T_1$, $T_2$, $T_3$ are dependent on the initial rotor speed and magnitude of the decrease therein.

As can be seen from re-acceleration curves 110, the method according to the present invention, by providing increased radial clearance between the blade tips and shroud during the transient mismatch following a decrease in engine power level, provides sufficient radial clearance to accommodate a subsequent re-acceleration of the engine from reduced power to full or cruise power without experiencing a excursion beneath the minimum required clearance $\delta_{MIN}$.

It should be noted, for that period in which the method according to the present invention has cut the flow of cooling air to the turbine case, engine efficiency is temporarily reduced due to the increased clearance provided between the blade tips and shroud. Such decrease in efficiency occurs only following a significant reduction in engine power level from cruise or operating power and only then for a period of time sufficient to protect the engine from the occurrence of interference during a subsequent re-acceleration. It has been estimated by a review of engine power level settings during a normal revenue flight that this reduction in efficiency averages a single occurrence per flight cycle and effects the operation of the engine for approximately 120 seconds, thus a temporary decrease in engine efficiency is the small price paid to avoid permanent removal of shroud material and permanent increase in blade tip to shroud clearance.

Figure 2:
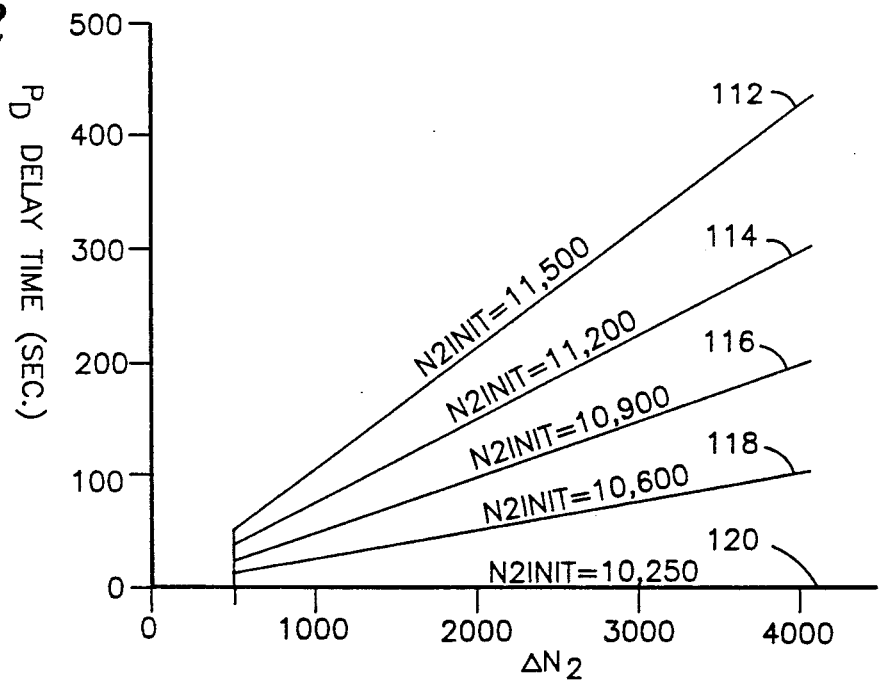
FIG. 2 is a graph of valve shut-off time as a function of the reduction in high rotor rpm and high rotor initial rpm.

FIG. 2 shows a sample schedule used by the method according to the present invention for calculating the length of delay time $P_D$ which will be imposed by the method following a decrease in engine power level. The method according to the present invention uses rotor speed or, in the case of a two spool gas turbine engine, high rotor speed as a measure of engine power level. Thus, curves 112, 114, 116, 118 and 120 represent the range of initial rotor speed $N_{2INIT}$ initial while the horizontal axis represents the magnitude of the decrease in rotor speed, $\Delta N_2$ which are used by the method according to the present invention to determine the delay before returning control of the modulating valve 44 to the normal controller 42.

For example, with an initial rotor speed of 11,500 rpm and a step decrease in rotor speed of 4,000 rpm, the method according to the present invention, using the schedule of FIG. 2 would maintain the modulating valve 44 in a closed position for approximately 410 seconds prior to returning control to the controller 42. As can be also seen in FIG. 2, initial turbine rotor speeds of 10,250 rpm or less will not require any interruption of cooling airflow to the turbine case 9 for a decrease in rpm of any magnitude. FIG. 2 also represents a practical lower limit on the change in rotor speed, $\Delta N_2$ which will trigger an interruption in cooling airflow. This lower limit of 500 rpm represents a practical lower limit on the change in engine power level below which a thermal mismatch between the turbine rotor and case is relatively insignificant.

It will be appreciated that FIG. 2 is but one representation of the relationship between high rotor initial speed and the change in high rotor speed, and that other formulas and schedules may be used depending upon parameters such turbine case thermal response, turbine rotor thermal response, cooling capacity of the turbine case cooling system, etc. The delay schedule may therefore be either calculated or determined experimentally for a given engine series or type.

We claim:

1. A method for controlling a flow of cooling air to a turbine case for controlling the radial clearance between the case and an internally disposed rotor, comprising the steps of:

(a) providing a schedule of cooling airflow as a function of steady state angular velocity;

(b) measuring the angular velocity of the rotor;

(c) positioning an airflow control valve responsive to the provided schedule and measured angular velocity;

(d) monitoring the rate of change of the rotor angular velocity; and (e) closing the valve, responsive to a monitored decrease in the rotor angular velocity greater than a preselected value, the valve remaining closed for a preselected period of time following the monitor decrease.

2. The method as recited in claim 1, wherein the preselected value is 500 rpm.

3. The method as recited in claim 1 wherein the preselected time period is a function of the rotor angular velocity prior to the monitored decrease.

4. The method as recited in claim 3, wherein the preselected time period is additionally a function of the magnitude of the monitored decrease.

* * * * *